US005393356A

United States Patent [19]

Singheiser

[11] Patent Number: 5,393,356

[45] Date of Patent: Feb. 28, 1995

[54] HIGH TEMPERATURE-RESISTANT MATERIAL BASED ON GAMMA TITANIUM ALUMINIDE

[75] Inventor: Lorenz Singheiser, Heidelberg, Germany

[73] Assignee: ABB Patent GmbH, Mannheim, Germany

[21] Appl. No.: 98,705

[22] Filed: Jul. 28, 1993

[30] Foreign Application Priority Data

Jul. 28, 1992 [DE] Germany ..... 4224867

[51] Int. Cl.[6] ..... C22C 14/00

[52] U.S. Cl. ..... 148/421; 420/418; 420/421

[58] Field of Search ..... 148/421; 420/418, 421

[56] References Cited

U.S. PATENT DOCUMENTS

| | | | |
|---|---|---|---|
| 4,891,184 | 1/1990 | Mikkola | 420/553 |
| 4,916,028 | 4/1990 | Huang | 420/418 |
| 5,045,406 | 9/1991 | Huang | 148/421 |
| 5,098,653 | 3/1992 | Huang | 420/418 |
| 5,120,497 | 6/1992 | Sayashi et al. | 420/418 |
| 5,196,162 | 3/1993 | Maki et al. | 420/418 |
| 5,204,058 | 4/1993 | Huang | 420/418 |
| 5,205,876 | 4/1993 | Sakai | 148/421 |
| 5,207,982 | 5/1993 | Nazmy et al. | 420/418 |
| 5,213,635 | 5/1993 | Huang | 148/421 |
| 5,226,985 | 7/1993 | Kim et al. | 420/418 |
| 5,264,051 | 11/1993 | Huang | 148/421 |

FOREIGN PATENT DOCUMENTS

| | | | |
|---|---|---|---|
| 0455005 | 11/1991 | European Pat. Off. | C22C 14/00 |
| 1094616 | 6/1960 | France . | |
| 4022403 | 1/1991 | Germany . | |
| 4121215 | 1/1992 | Germany . | |
| 4121228 | 1/1992 | Germany . | |
| 4140679 | 6/1992 | Germany . | |
| 0425138 | 10/1992 | Japan | C22C 14/00 |
| 2245594 | 1/1992 | United Kingdom | C22C 14/00 |

*Primary Examiner*—Upendra Roy

*Attorney, Agent, or Firm*—Herbert L. Lerner; Laurence A. Greenberg

[57] ABSTRACT

A multi-phase, high temperature-resistant material with an intermetallic base alloy of the γ-TiAl type, is intended in particular for use in heat engines, such as internal combustion engines, gas turbines and aircraft engines. The material has a content of aluminum of from 30 to 40 atom %, silicon of from 0.1 to 20 atom %, niobium of from 0.1 to 15 atom %, and a remainder of titanium.

7 Claims, No Drawings

HIGH TEMPERATURE-RESISTANT MATERIAL BASED ON GAMMA TITANIUM ALUMINIDE

BACKGROUND OF THE INVENTION

FIELD OF THE INVENTION

The invention relates to a multi-phase, high temperature-resistant material being formed of an alloy based on an intermetallic compound of the γ-TiAl type, in particular for use in heat engines such as internal combustion engines, gas turbines and aircraft engines.

The development of heat engines is moving increasingly to higher power at a structural size which remains the same as far as possible, so that heat stress on individual components is continually increased and therefore improved heat resistance as well as strength are increasingly demanded from the materials being employed.

In addition to numerous developments in the materials field, for example nickel-based alloys, alloys based on an intermetallic compound of the γ-TiAl type have particularly gained increasing interest for such a use in heat engines, because of the high melting point coupled with low density. Numerous developments deal with the attempt to improve the mechanical properties of such high-temperature materials. In addition to the improvement of the mechanical properties, the resistance to corrosive attack at the high temperatures that are in use particularly plays a special part, for example the resistance to attack by hot combustion gases, gaseous chlorides and sulphur dioxide.

Furthermore, the service life at lower temperatures is limited by condensed alkali metal sulphates and alkaline earth metal sulphates, so that an exploitation of the potential strength of these materials which is present per se, is prevented. In other words, the use temperature that is actually achievable as viewed from the high-temperature strength, is reduced because of the restricted oxidation resistance.

It is well known that the oxidation resistance of the binary titanium/aluminum compounds is completely inadequate for the above-mentioned applications, since the oxidation rate lies several powers of ten above that of superalloys used today, and their oxide layers have a low adhesive strength, which leads to continuous corrosive wear. It is known that at temperatures above 900 C., compounds based on titanium aluminide with significant contents of chromium and vanadium admittedly show good oxidation resistance which is comparable with that of superalloys used today, but show a completely inadequate oxidation behavior at lower temperatures, which is comparable with that of binary titanium aluminides, such as γ-TiAl.

In the same way, the mechanical properties of such compounds are completely inadequate for industrial applications. At low temperatures, they have virtually no ductility, and they possess an inadequate creep resistance or fatigue strength at higher temperatures.

SUMMARY OF THE INVENTION

It is accordingly an object of the invention to provide a high temperature-resistant material, which overcomes the hereinafore-mentioned disadvantages of the heretofore-known materials of this general type and which has both the desired mechanical properties and the requisite corrosion resistance.

With the foregoing and other objects in view there is provided, in accordance with the invention, a high temperature-resistant material with inter-metallic compounds in the titanium/aluminum system, in particular for use in heat engines, such as internal combustion engines, gas turbines and aircraft engines, comprising an aluminum content of from 45 to 60 atom %, a silicon content of from 0.1 to 20 atom %, a niobium content of from 0.1 to 15 atom %, and a titanium remainder.

Accordingly, a TiAl base alloy with an aluminum content of 45–60 atom % is considerably improved in its oxidation resistance by alloying with silicon (0.1 to 20 atom %) and niobium (0.1 to 15 atom %), with the remainder being titanium. The indicated additions of silicon lead to the formation of $Ti_5Si_3$ precipitations and therefore to a considerable reduction in the oxidation rate, coupled with increased adhesion of the oxide layer. In particular, the indicated additions of niobium, in combination with silicon, effect a further lowering of the oxidation rate, coupled with increased oxide adhesion. The additions of silicon and niobium in the oxide layer lead to a reduced proportion of titanium dioxide ($TiO_2$,) which has a high growth rate due to its high inherent imperfection.

At the same time, the alloying with silicon and niobium leads to the formation of a two-phase micro-structure which, as compared with the γ-TiAl base alloy, shows a marked improvement in the mechanical high temperature strength and fatigue strength.

In accordance with another feature of the invention, the contents of silicon and niobium are supplemented or replaced by alloying with chromium, tantalum, tungsten, molybdenum or vanadium or combinations of these elements. Possible alloy contents in this case are 0.1 to 20 atom % for chromium, 0.1 to 10 atom % for tantalum, and 0.1 to 5 atom % for tungsten, molybdenum and vanadium.

The formation of dense protective oxide layers is of particular importance for the titanium aluminides, since they prevent the penetration of oxygen and nitrogen into the core matrix and therefore prevent the embrittlement thereof.

In accordance with a further feature of the invention, there is provided an addition of so-called reactive elements such as, for example, yttrium, hafnium, erbium and lanthanum, and other rare earths or combinations of these elements can be provided. This is done in order to hold back the diffusion of dissolved oxygen and nitrogen, or to at least significantly reduce it. On one hand, these oxides and nitrides are considerably more stable thermodynamically than those of titanium, and on the other hand, these elements at the same time provide an increase in the oxidation resistance of the indicated intermetallic compounds.

The preparation and processing of the high temperature material according to the invention causes no particular difficulties, and can be carried out by conventional processes such as are employed with materials of this type, for example by lost-wax casting, directional solidification or powder-metallurgical means.

In accordance with an added feature of the invention, the high-temperature material according to the invention is prepared with the addition of oxides of the above-mentioned reactive elements by mechanical alloying, in order to obtain particularly heat-resistant intermetallic compounds.

In accordance with a concomitant feature of the invention, there is provided an addition of boron (0.05 to 5 atom %) or carbon or nitrogen (0.05 to 1 atom %) or combinations of these elements, in order to achieve a further improvement in the mechanical properties and a fine-grained microstructure. This is accomplished by the fact that, due to the additions of boron, carbon and nitrogen, stable borides, carbides and nitrides or carbonitrides are formed.

The last-mentioned additions of boron, carbon and nitrogen are of particular importance in connection with the directional solidification of these intermetallic compounds, whereby the precipitation of elongate compounds such as, for example, borides, silicides and similar compounds having a strength-enhancing effect, is promoted.

These and further advantageous compositions and processing information are the subject of the claims.

Although the invention is described herein as embodied in a high temperature-resistant material, it is nevertheless not intended to be limited to the details given, since various modifications and structural changes may be made therein without departing from the spirit of the invention and within the scope and range of equivalents of the claims.

The structure of the invention, however, together with additional objects and advantages thereof will be best understood from the foregoing description of specific embodiments.

I claim:

1. A high temperature-resistant material with intermetallic compounds in the titanium/aluminum system, comprising an aluminum content of from 45 to 48 atom %, a niobium content of from 0.5 to 3 atom %, a chromium content of from 0.5 to 3 atom %, a silicon content of from 0.1 to 2 atom %, an oxidation resistance-enhancing element selected from the group consisting of, in atom %, 0.5 to 3 tantalum, 0.5 to 3 molybdenum, 0.5 to 3 tungsten, 0.5 to 3 vanadium, 0.1 to 1 boron, 0.01 to 1 carbon, 0.01 to 1 nitrogen, 0.01 to 1 yttrium, 0.01 to 1 cerium, 0.01 to 1 erbium, and 0.01 to 1 lanthanum, and a remainder of titanium;

said yttrium, cerium, lanthanum and erbium summing to a total of no more than 2 atom %; and said niobium, chromium, silicon, tantalum, molybdenum, tungsten, vanadium, boron, carbon, and nitrogen summing to a total of no more than 10 atom %.

2. The high-temperature-resistant material according to claim 1, including from 0.05 to 2 atom % of hafnium.

3. The high temperature-resistant material according to claim 1, wherein the material is produced by mechanical alloying.

4. In a heat engine, a high temperature-resistant material with inter-metallic compounds in the titanium-/aluminum system, comprising an aluminum content of from 45 to 48 atom %, a niobium content of from 0.5 to 3 atom %, a chromium content of from 0.5 to 3 atom %, a silicon content of from 0.1 to 2 atom %, an oxidation resistance-enhancing element selected from the group consisting of, in atom %, 0.5 to 3 tantalum, 0.5 to 3 molybdenum, 0.5 to 3 tungsten, 0.5 to 3 vanadium, 0.1 to 1 boron, 0.01 to 1 carbon, 0.01 to 1 nitrogen, 0.01 to 1 yttrium, 0.01 to 1 cerium, 0.01 to 1 erbium, and 0.01 to 1 lanthanum, and a remainder of titanium;

said yttrium, cerium, lanthanum and erbium summing to a total of no more than 2 atom %; and said niobium, chromium, silicon, tantalum, molybdenum, tungsten, vanadium, boron, carbon, and nitrogen summing to a total of no more than 10 atom %.

5. In an internal combustion engine, a high temperature-resistant material with inter-metallic compounds in the titanium/aluminum system, comprising an aluminum content of from 45 to 48 atom %, a niobium content of from 0.5 to 3 atom %, a chromium content of from 0.5 to 3 atom %, a silicon content of from 0.1 to 2 atom %, an oxidation resistance-enhancing element selected from the group consisting of, in atom %, 0.5 to 3 tantalum, 0.5 to 3 molybdenum, 0.5 to 3 tungsten, 0.5 to 3 vanadium, 0.1 to 1 boron, 0.01 to 1 carbon, 0.01 to 1 nitrogen, 0.01 to 1 yttrium, 0.01 to 1 cerium, 0.01 to 1 erbium, and 0.01 to 1 lanthanum, and a remainder of titanium;

said yttrium, cerium, lanthanum and erbium summing to a total of no more than 2 atom %; and said niobium, chromium, silicon, tantalum, molybdenum, tungsten, vanadium, boron, carbon, and nitrogen summing to a total of no more than 10 atom %.

6. In a gas turbine, a high temperature-resistant material with inter-metallic compounds in the titanium-/aluminum system, comprising an aluminum content of from 45 to 48 atom %, a niobium content of from 0.5 to 3 atom %, a chromium content of from 0.5 to 3 atom %, a silicon content of from 0.1 to 2 atom %, an oxidation resistance-enhancing element selected from the group consisting of, in atom %, 0.5 to 3 tantalum, 0.5 to 3 molybdenum, 0.5 to 3 tungsten, 0.5 to 3 vanadium, 0.1 to 1 boron, 0.01 to 1 carbon, 0.01 to 1 nitrogen, 0.01 to 1 yttrium, 0.01 to 1 cerium, 0.01 to 1 erbium, and 0.01 to 1 lanthanum, and a remainder of titanium;

said yttrium, cerium, lanthanum and erbium summing to a total of no more than 2 atom %; and said niobium, chromium, silicon, tantalum, molybdenum, tungsten, vanadium, boron, carbon, and nitrogen summing to a total of no more than 10 atom %.

7. In an aircraft engine, a high temperature-resistant material with inter-metallic compounds in the titanium-/aluminum system, comprising an aluminum content of from 45 to 48 atom %, a niobium content of from 0.5 to 3 atom %, a chromium content of from 0.5 to 3 atom %, a silicon content of from 0.1 to 2 atom %, an oxidation resistance-enhancing element selected from the group consisting of, in atom %, 0.5 to 3 tantalum, 0.5 to 3 molybdenum, 0.5 to 3 tungsten, 0.5 to 3 vanadium, 0.1 to 1 boron, 0.01 to 1 carbon, 0.01 to 1 nitrogen, 0.01 to 1 yttrium, 0.01 to 1 cerium, 0.01 to 1 erbium, and 0.01 to 1 lanthanum, and a remainder of titanium;

said yttrium, cerium, lanthanum and erbium summing to a total of no more than 2 atom %; and said niobium, chromium, silicon, tantalum, molybdenum, tungsten, vanadium, boron, carbon, and nitrogen summing to a total of no more than 10 atom %.

* * * * *